US006851983B2

(12) United States Patent
Yin et al.

(10) Patent No.: US 6,851,983 B2
(45) Date of Patent: Feb. 8, 2005

(54) ELECTRIC CONNECTOR

(75) Inventors: Hung-Jiun Yin, Wuxi (CN); Yz-Jiun Wu, Wuxi (CN)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/603,414

(22) Filed: Jun. 25, 2003

(65) Prior Publication Data

US 2004/0102063 A1 May 27, 2004

(30) Foreign Application Priority Data

Jun. 25, 2002 (TW) ..... 91209578 U

(51) Int. Cl.[7] ..... H01R 24/00
(52) U.S. Cl. ..... 439/660; 439/862
(58) Field of Search ..... 439/862, 81, 660, 439/500, 68

(56) References Cited

U.S. PATENT DOCUMENTS 3,611,272 A * 10/1971 Fairbairn et al. ..... 439/681
5,338,230 A * 8/1994 Bryce et al. ..... 439/629
5,980,323 A * 11/1999 Bricaud et al. ..... 439/630
6,302,727 B1 * 10/2001 Fedorjaka ..... 439/500
6,315,621 B1 * 11/2001 Natori et al. ..... 439/862
6,485,338 B1 * 11/2002 Wu ..... 439/862
2003/0104731 A1 * 6/2003 Chang ..... 439/862
2003/0190848 A1 * 10/2003 Wu ..... 439/862

* cited by examiner

*Primary Examiner*—Hien Vu
(74) *Attorney, Agent, or Firm*—Stephen Z. Weiss

(57) ABSTRACT

An electric connector formed of an electrically insulative housing and terminals installed in respective terminal slots of the housing is disclosed in which each terminal has a U-shaped springy supporting portion supported inside one terminal slot of the housing, a vertical arm downwardly extended from one end of the U-shaped springy supporting portion, and a contact tip extended from the bottom end of the vertical arm suspended outside the housing for the contact of a corresponding contact of a circuit board.

5 Claims, 7 Drawing Sheets

PRIOR ART

PRIOR ART

ELECTRIC CONNECTOR

FIELD OF THE INVENTION

The present invention relates to electric connectors and, more particularly, to such an electric connector, which effectively reduces the installation space of the matching circuit board and, achieves a satisfactory electric connection effect.

DESCRIPTION OF THE RELATED ART

FIG. 1 shows an I/O (Input/Output) electric connector 1*a* for use in an electronic apparatus. This structure of electric connector 1*a* comprises an electrically insulative housing 10*a*, and a plurality of terminals 11*a* mounted in respective terminal slots 12*a* in the housing 10*a*. With reference to FIGS. 1 and 2, each terminal 11*a* comprises a cured springy supporting portion 13*a*, a contact tip 15*a* suspending outside the housing 10*a*, and a straight bearing arm 14*a* connected between the springy supporting portion 13*a* and the contact tip 15*a*. During installation, the contact tip 15*a* is maintained in contact with a respective contact 20*a* of the circuit board 2*a* inside the electronic apparatus.

The aforesaid prior art electric connector 1*a* has drawbacks. As shown in FIGS. 3 and 4, the straight bearing arm 14*a* is obliquely upwardly extended from the springy supporting portion 13*a* toward the contact tip 15*a*. When the circuit board 20*a* moved downwards and set into position after contact of the respective contacts 20*a* with the contact tips 15*a* of the terminals 11*a* of the electric connector 1*a*, the springy supporting portion 13*a* is deformed, and the sliding friction between the contact tips 15*a* of the terminals 11*a* and the contacts 20*a* of the circuit board 2*a* is shifted from position A to position B through a displacement distance S. Due to the sliding friction between the contact tips 15*a* of the terminals 11*a* and the contacts 20*a* of the circuit board 2*a*, the electronic apparatus must provide a room for such a displacement distance S. This design does not fit the current electronic apparatus design concept of minimizing the size. Further, the contact of sliding friction is not stable. Frequently detaching and re-installing the electric connector 1*a* and the circuit board 2*a* causes the contact tips 15*a* of the terminals 11*a* and the contacts 20*a* of the circuit board 2*a* to wear quickly.

Therefore, it is desirable to provide an electric connector that eliminates the aforesaid drawbacks.

SUMMARY OF THE INVENTION

The present invention has been accomplished under the circumstances in view. It is therefore the main object of the present invention to provide an electric connector, which contacts the contacts of the matching circuit board through a point contact without producing a sliding friction so as to minimize the installation space of the matching circuit board and to meet the electronic apparatus design concept of minimizing the size.

To achieve this and other objects of the present invention, the electric connector comprises an electrically insulative housing, the housing comprising a plurality of terminal slots, and a plurality of terminals respectively mounted in the terminal slots of the housing and disposed in contact with respective contacts of a circuit board in an electronic apparatus, wherein the terminals each comprise a springy supporting portion supported inside one terminal slot of the housing, a vertical arm downwardly extended from one end of the springy supporting portion, and a contact tip extended from a bottom end of the vertical arm remote from the springy supporting portion and suspended outside the housing for the contact of one contact of the circuit board.

DETAILED DESCRIPTION OF THE PREFERRED EMBODIMENT

Figure 1:
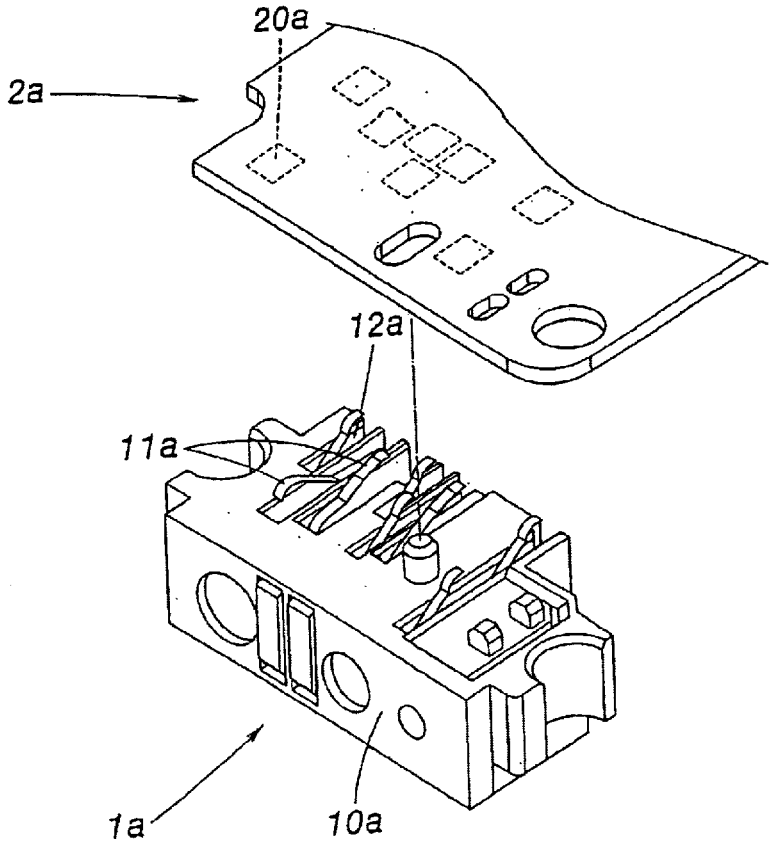
FIG. 1 is an exploded view of an electric connector and a circuit board according to the prior art.
Figure 2:
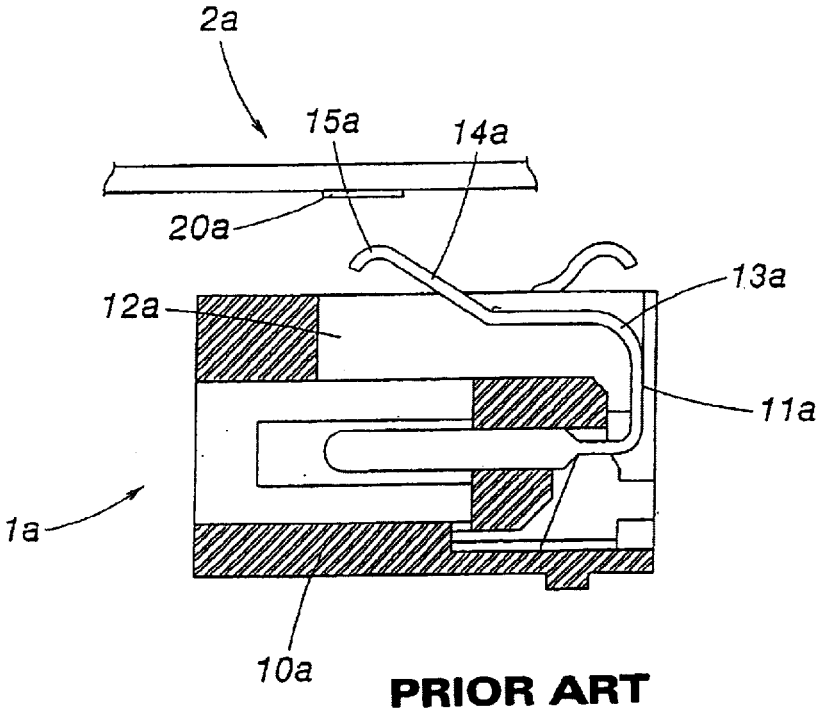
PRIOR ART FIG. 2
FIG. 2 is a plain view in section of the electric connector and the circuit board according to the prior art.
Figure 3:
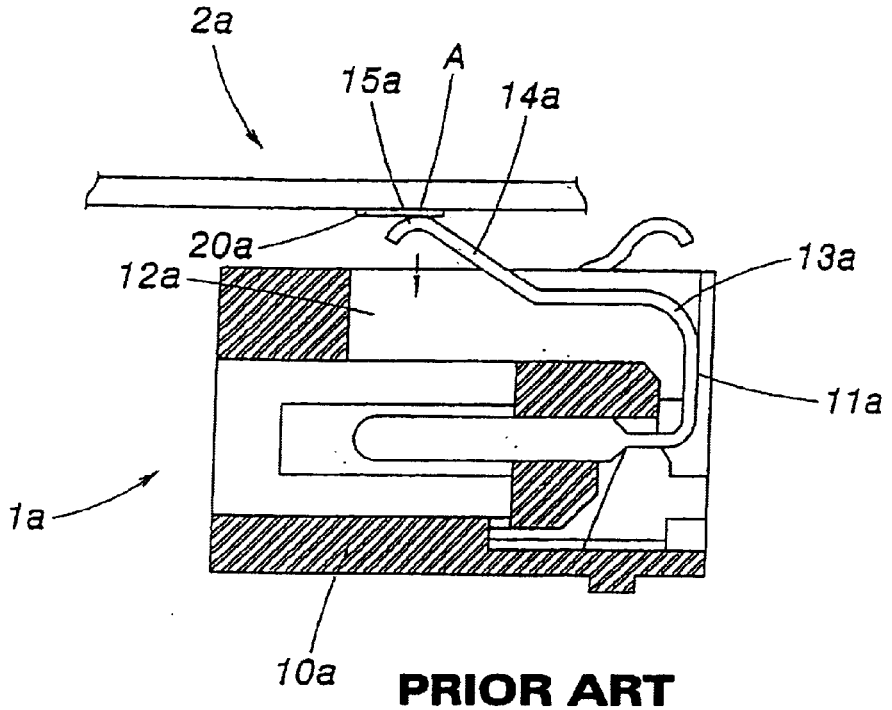
FIG. 3 illustrates the initial contact stage between the circuit board and the electric connector according to the prior art.
Figure 4:
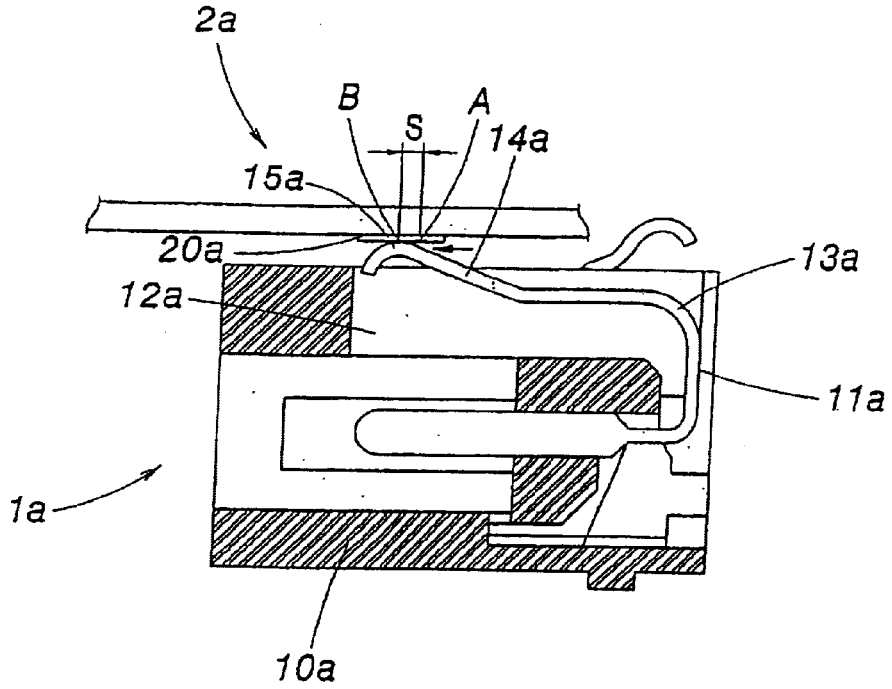
PRIOR ART FIG. 4
FIG. 4 is similar to FIG. 3 but showing the circuit board set into position, the sliding friction between the contact tips of the terminals and the contacts of the circuit board shifted from position A to position B.
Figure 5:
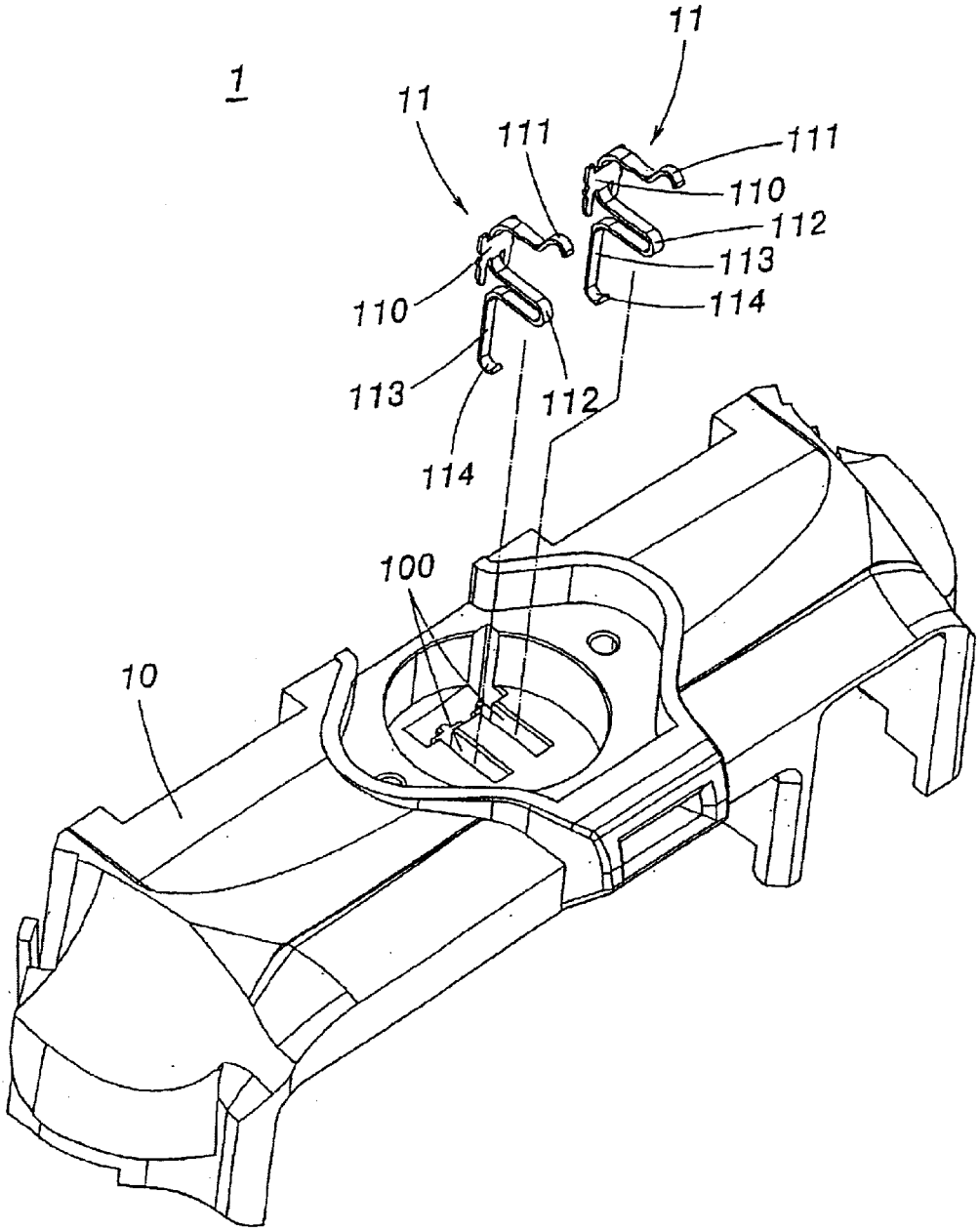
FIG. 5 is an exploded view of an electric connector according to the present invention.
Figure 6:
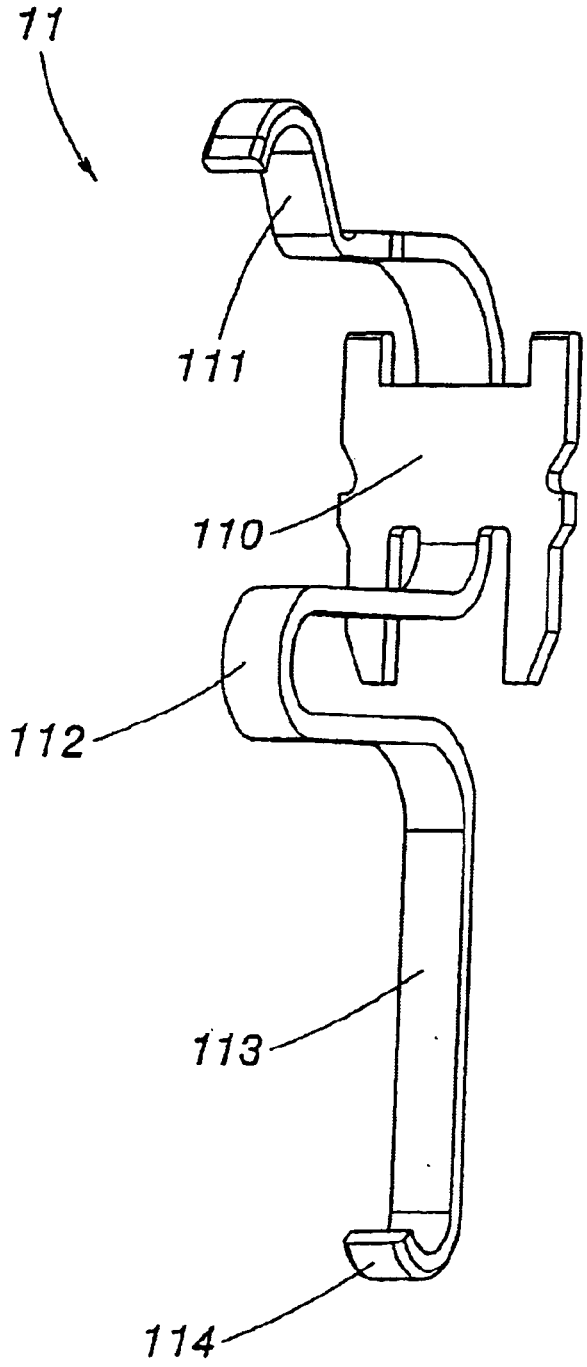
FIG. 6 is an elevational view of in an enlarged scale of one terminal of the electric connector shown in FIG. 5.
Figure 7:
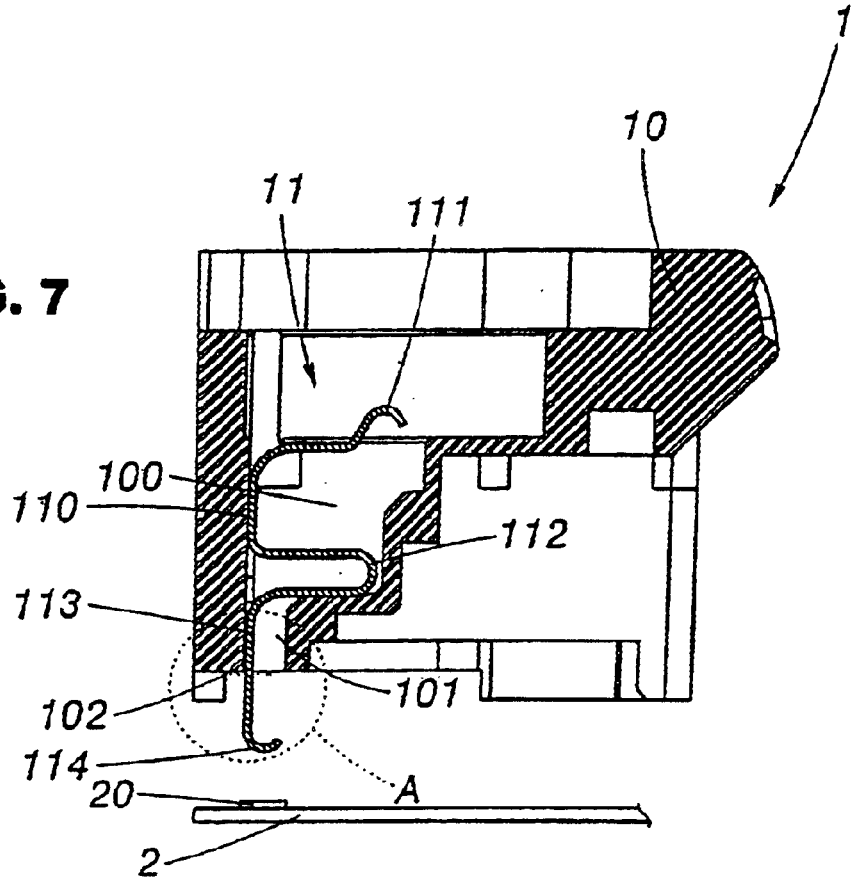
FIG. 7 is a plain view in section of the electric connector and the matching circuit board according to the present invention.

Referring to FIGS. 5~7, an electric connector is installed in an electronic apparatus (not shown) and electrically connected to the contacts 20 of a circuit board 2 inside the electronic apparatus. The electric connector 1 comprises an electrically insulative housing 10 and a plurality of terminals 11.

The housing 10 is injection-molded from plastics, comprising a plurality of terminal slots 100. Each terminal slot 100 has a bottom end terminating in a narrow passage 101 cut through the bottom side of the housing 10. The narrow passage 101 has one bearing sidewall 102 (see FIG. 7A). The other part of each terminal slot 100 is similar to the conventional designs.

The terminals 11 are respectively mounted in the terminal slots 100 of the housing 10, each having a positioning portion 110 positioned in the corresponding terminal slot 100, a top contact arm 111 extended from one side, namely, the top side of the positioning portion 110 and adapted to contact one contact of an external electronic device (not shown), a substantially U-shaped springy supporting portion 112 extended from the other side, namely, the bottom side of the positioning portion 110 and supported inside the corresponding terminal slot 100, a vertical arm 113 downwardly extended from one end of the U-shaped springy supporting portion 112 remote from the positioning portion 110 and stopped at the bearing sidewall 102 of the corresponding terminal slot 100, and a bottom contact tip 114 extended from one end of the vertical arm 113 remote from the U-shaped springy supporting portion 112 and suspended outside the housing 10 for the contact of the corresponding contact 20 of the circuit board 2. When the contacts 20 of the circuit board 2 set into contact with the contact tips 114 of the terminals 11, the vertical arm 113 of each terminal 11 is maintained perpendicular to the circuit board 2.

Figure 7A:
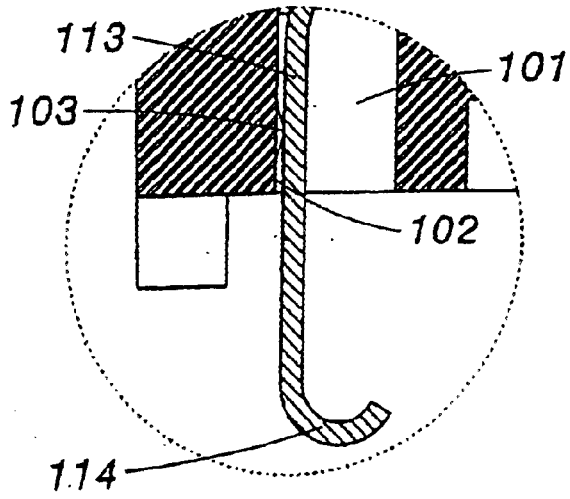
FIG. 7A is an enlarged view of a part of FIG. 7.
Figure 10:
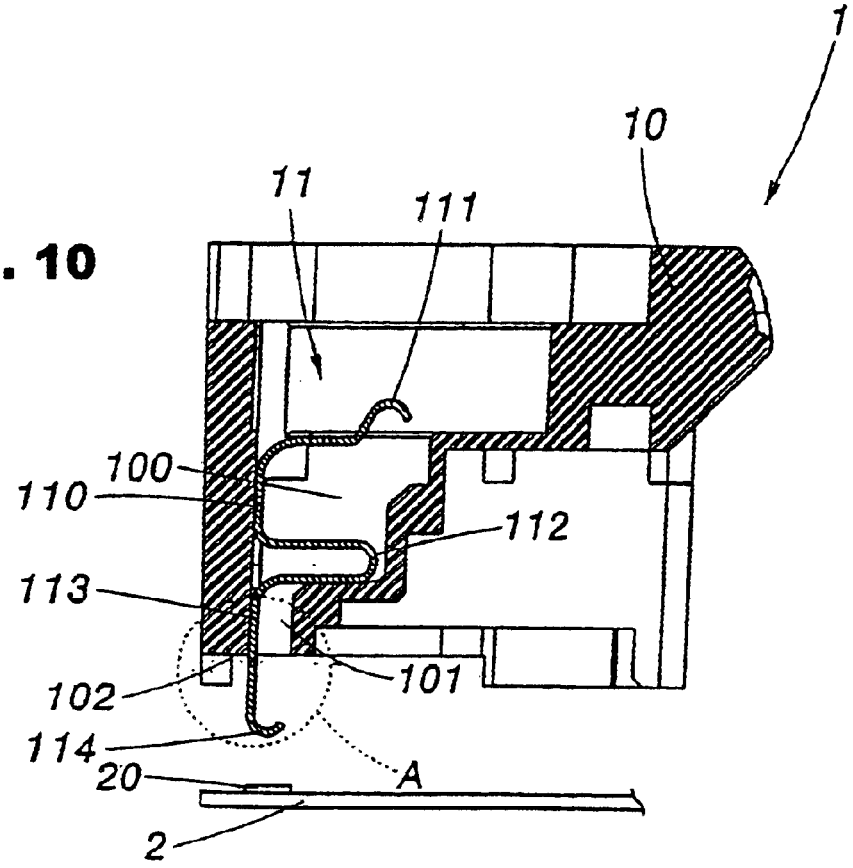
FIG. 10 is a plain view in section of the electric connector and the matching circuit board according to an alternate form of the present invention.
Figure 10A:
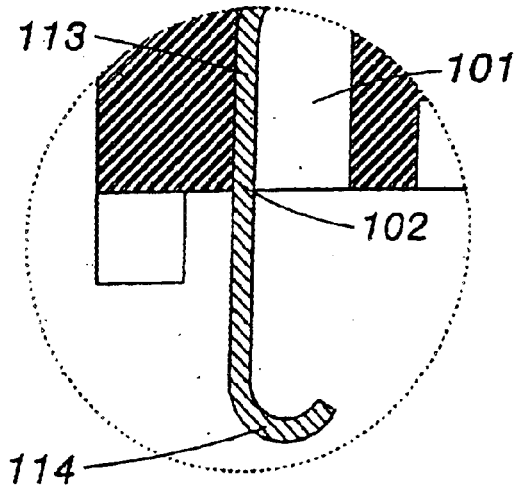
FIG. 10A is an enlarged view of a part of FIG. 10.

The housing 10 can be made having a protruded stop portion 103 in narrow passage 101 of each terminal slot 100 to support the vertical arm 113 of the corresponding terminal 11 (see FIG. 7A). Alternatively, the bearing sidewall 102 of each terminal slot 100 can be slightly sloping in one direction to support the vertical arm 113 in a slightly tilted position (see FIGS. 10 and 10A).

Figure 8:
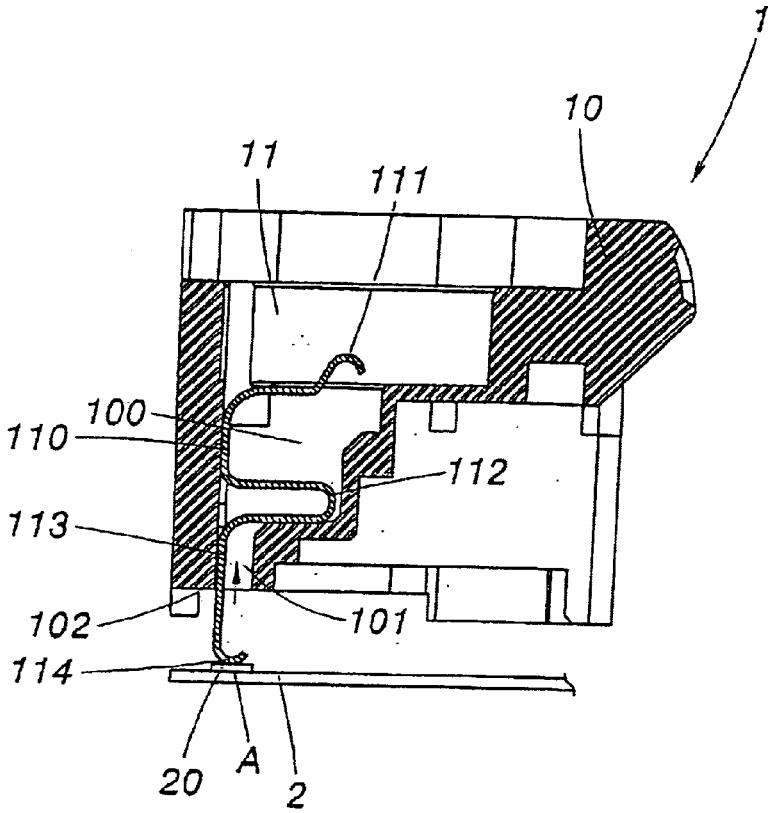
FIG. 8 illustrates the initial contact stage between the contacts of the circuit board and the contact tips of the terminals of the electric connector according to the present invention.
Figure 9:
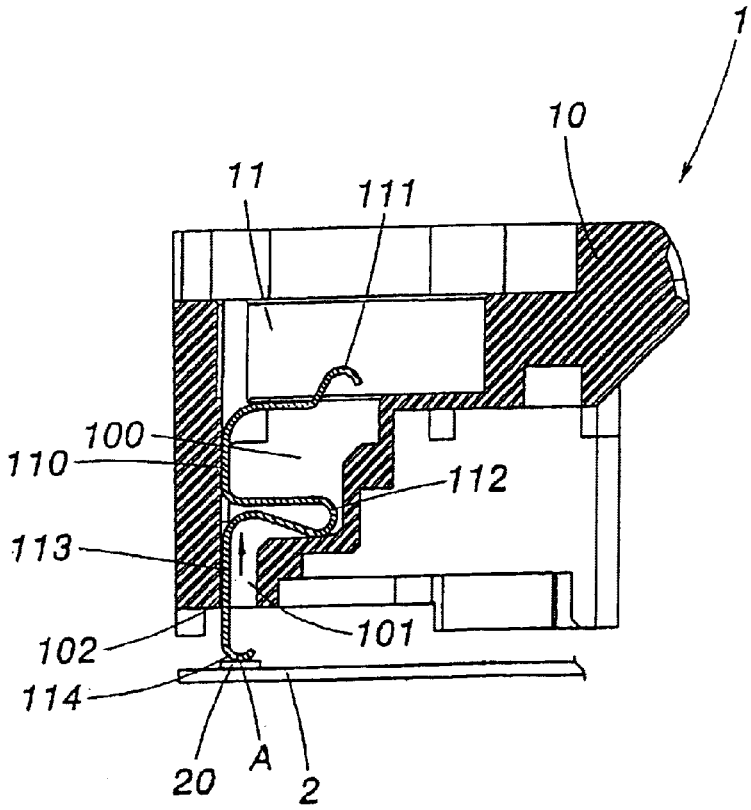
FIG. 9 is similar to FIG. 8 but showing the U-shaped springy supporting portion of the terminal deformed.

Referring to FIGS. 8 and 9, when the contact tip 114 of each terminal 11 touched the corresponding contact 20 of the circuit board 2, the pressure imparted from the circuit board 2 to each terminal 11 passes in direction parallel to the vertical arm 113, therefore the contact area between the contact tip 114 of each terminal 11 and the corresponding contact 20 of the circuit board 2 is constantly maintained in position A, i.e., the contact between the contact tip 114 of each terminal 11 and the corresponding contact 20 of the circuit board 2 is a point contact without producing a sliding friction. Because the contact between the contact tip 114 of each terminal 11 and the corresponding contact 20 of the circuit board 2 is a point contact, the circuit board 20 requires less installation space and, can be maintained in contact with the terminals 11 of the electric connector positively and stably Referring to FIGS. 7 and 7A, or 10 and 10A, the design of the protruded stop portion 103 in narrow passage 101 of each terminal slot 100 or the sloping design of the bearing sidewall 102 of each terminal slot 100 prevents the vertical arm 113 of the respective terminal 11 from biasing during installation of the circuit board 2.

A prototype of electric connector has been constructed with the features of the annexed drawings of FIGS. 5~10. The electric connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric connector comprising:

an insulative housing, said housing comprising a plurality of terminal slots, and a plurality of terminals respectively mounted in said terminal slots of said housing and disposed in contact with respective contacts of a circuit board in an electronic apparatus, wherein said terminals each comprise a springy supporting portion supported inside one terminal slot of said housing, a moveable vertical arm downwardly extended from one end of said springy supporting portion, and a contact tip extended from a bottom end of said vertical arm remote from said springy supporting portion and suspended outside said housing for the contact of one contact of said circuit board, and said terminal slots of said housing each have a bottom end terminating in a narrow passage cut through a bottom side of said housing, said narrow passage having one bearing sidewall adapted to support the moveable vertical arm of the corresponding terminal, wherein said terminals each further comprise a positioning portion integral with a second end of said springy supporting portion opposite said one end and remote from said movable arm and positioned against the one bearing sidewall in the corresponding terminal slot inside said housing.

2. The electric connector as claimed in claim 1, wherein said bearing sidewall has a protruded stop portion stopped against one side of the moveable vertical arm of the corresponding terminal.

3. The electric connector as claimed in claim 1, wherein said bearing sidewall slopes in one direction.

4. The electric connector as claimed in claim 1, wherein said terminals each further comprise a curved contact arm upwardly extended from one side of said positioning portion remote from said springy supporting portion.

5. The electric connector as claimed in claim 1, wherein the springy supporting portion of each of said terminals has a U-shaped profile.

* * * * *